US012611035B2

(12) United States Patent
Chen

(10) Patent No.: US 12,611,035 B2
(45) Date of Patent: Apr. 28, 2026

(54) EASY-TO-TRANSPORT CHAIR

(71) Applicant: SOPHIA & WILLIAM BRANDS CO. LTD, Nanjing (CN)

(72) Inventor: Meidi Chen, Nanjing (CN)

(73) Assignee: SOPHIA & WILLIAM BRANDS CO. LTD, Nanjing (CN)

( * ) Notice: Subject to any disclaimer, the term of this patent is extended or adjusted under 35 U.S.C. 154(b) by 124 days.

(21) Appl. No.: 18/622,924

(22) Filed: Mar. 30, 2024

(65) Prior Publication Data

US 2025/0261759 A1 Aug. 21, 2025

(30) Foreign Application Priority Data

Feb. 21, 2024 (CN) ..... 202420324000.6

(51) Int. Cl.
*A47C 4/02* (2006.01)
*A47C 7/54* (2006.01)

(52) U.S. Cl.
CPC ..... *A47C 4/02* (2013.01); *A47C 7/546* (2013.01)

(58) Field of Classification Search
CPC ..... A47C 4/02; A47C 7/546
See application file for complete search history.

(56) References Cited

U.S. PATENT DOCUMENTS 5,407,250 A * 4/1995 Prince ..... A47C 4/03 297/440.22
5,762,403 A * 6/1998 Robinson ..... A47C 31/023 297/440.11
11,540,634 B2 * 1/2023 Sun ..... A47C 4/283
2002/0135158 A1 * 9/2002 Davidson ..... A61G 5/1091 280/647
2007/0108823 A1 * 5/2007 Grabowski ..... A47C 13/005 297/354.1
2007/0271704 A1 * 11/2007 Breeland ..... A61G 5/1091 5/653
2009/0224576 A1 * 9/2009 Shen ..... A47C 5/14 297/16.1
2016/0174718 A1 * 6/2016 Orlandoni ..... A47C 5/06 297/452.63
2018/0035816 A1 * 2/2018 Leng ..... A47C 17/17
2023/0133461 A1 * 5/2023 Gibilterra ..... A47C 3/023 297/271.6

FOREIGN PATENT DOCUMENTS

CN 209186057 U 8/2019
CN 213282236 U 5/2021
CN 213993002 U 8/2021

* cited by examiner

*Primary Examiner* — Rodney A Bonnette
(74) *Attorney, Agent, or Firm* — Nitin Kaushik

(57) ABSTRACT

The present utility model relates to the technical field of chairs, and particularly relates to an easy-to-transport chair, the chair including a left armrest and a right armrest provided symmetrically and bolted by a front support bar and a rear support bar, a seat board being horizontally bolted on the inner sides of the symmetrical left armrest and right armrest, and a backrest being vertically bolted on the symmetrical left armrest and right armrest; wherein the left armrest and the right armrest are sized and structured the same; the chair is easy to disassemble and assemble, which saves the space taken up by packaging and reduces transportation costs.

7 Claims, 10 Drawing Sheets

EASY-TO-TRANSPORT CHAIR

CROSS-REFERENCE TO RELATED APPLICATIONS

The application claims priority to Chinese patent application No. 2024203240006, filed on Feb. 21, 2024, the entire contents of which are incorporated herein by reference.

TECHNICAL FIELD

The present utility model relates to the technical field of seats, and particularly relates to an easy-to-transport chair.

BACKGROUND

An existing seat generally includes a backrest for supporting the back of a human body, a seat board for supporting the human body, etc. Since the backrest is inclined backward and is integrally formed with the seat board, when the seat is transported, placement of the seat takes up a large space, thereby increasing transportation costs.

To this end, the present applicant has provided an easy-to-transport chair to solve the problems proposed in the above background.

SUMMARY

An objective of the present utility model is to provide an easy-to-transport chair, and solve the problems of existing seats taking up a large space during transportation and increasing transportation costs.

In order to solve the above-mentioned technical problem, the present utility model provides an easy-to-transport chair, the chair including a left armrest and a right armrest provided symmetrically and bolted by a front support bar and a rear support bar, a seat board being horizontally bolted on the symmetrical left armrest and right armrest, and a backrest being vertically bolted on the symmetrical left armrest and right armrest; wherein the left armrest and the right armrest are sized and structured the same.

Further, the backrest, the seat board, the left armrest, the right armrest, the front support bar and the rear support bar are separate parts and detachable.

Further, the front support bar is bolted to the front sides of the left armrest and the right armrest.

Further, the rear support bar is bolted to the rear sides of the left armrest and the right armrest.

Further, front screw holes on both sides of the front end of the body of the seat board are adapted to be bolted on the front sides of the left armrest and the right armrest; the rear screw holes on both sides of the rear end of the chair seat board body thereof are adapted to be bolted on the rear sides of the left armrest and the right armrest.

Further, an upper screw hole and a lower screw hole in the backrest are bolted to the rear sides of the left armrest and the right armrest.

Further, the left armrest and the right armrest are higher than the horizontally provided seat board.

Further, a front arc board is fixedly provided at both ends of the body of the front support bar, and a front screw hole AB, a front screw hole B, a front screw hole C and a front screw hole D are respectively provided at both ends of the front arc board away from the front support bar.

Further, a rear straight board is fixedly provided at both ends of the body of the rear support bar, and a rear screw hole A, a rear screw hole BB, a rear screw hole C, and a rear screw hole D are respectively provided at both ends of the rear straight board away from the rear support bar.

Further, an interwoven PVC-coated polyester fabric (Textilene®), a commercial fabric material) is fixedly provided on the front surface of the body of the backrest and the body of the seat board, respectively.

Further, an upper portion of the backrest body is laterally provided with an upper cross beam, and a lower portion thereof is laterally provided with a lower cross beam.

Further, the front portion of the seat board body is laterally provided with a front cross beam, and the rear portion thereof is laterally provided with a rear cross beam.

Further, a front screw hole AA, a rear screw hole BA, a front support bar screw hole, and a rear support bar screw hole are respectively provided on the body of the left armrest.

With the above technical solution, the present utility model has the following beneficial effects:

1. the present utility model provides a convenient easy-to-transport chair, wherein the seat is a separate part for easy disassembly and assembly; the chair backrest and chair seat board are independently and separately packaged for convenience of users, saving packaging space and reducing transportation costs.

BRIEF DESCRIPTION OF DRAWINGS

In order to more clearly illustrate the embodiments of the present utility model or the technical solutions in the prior art, the drawings used in the embodiments or the prior art descriptions will be briefly described below, and it is obvious that the drawings in the following description are some embodiments of the present utility model, and other drawings can be obtained by a person skilled in the art without creative efforts.

REFERENCE NUMERALS

Figure 1:
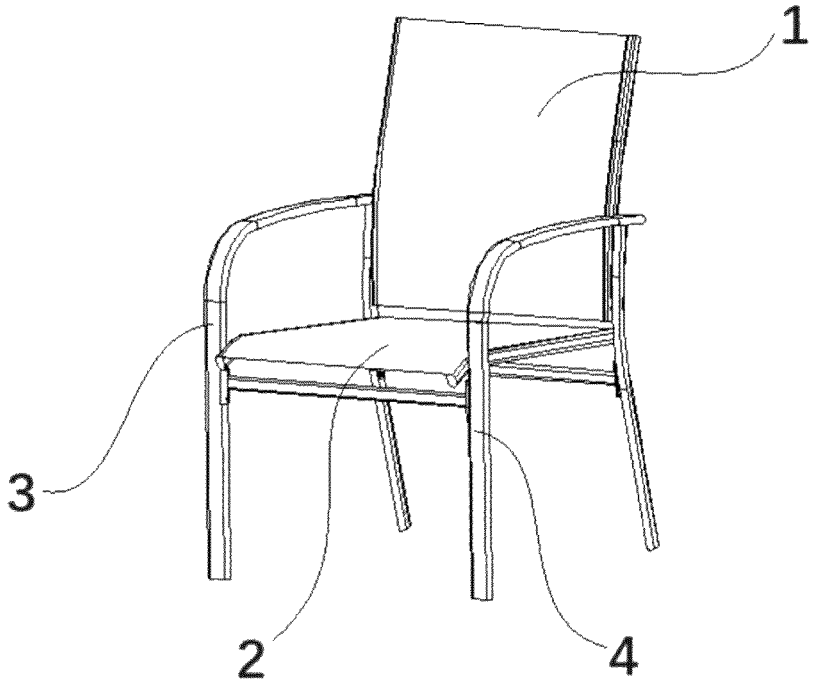
FIG. 1 is an overall schematic diagram showing an easy-to-transport chair.

1—backrest; 2—seat board; 3—left armrest; 4—right armrest; 5—front support bar; 6—rear support bar; 11—upper screw hole; 12—lower screw hole; 13—lower cross beam; 14—upper cross beam; 15—an int PVC-coated polyester fabric (Textilene®) a commercial fabric material); 21—front screw hole; 22—front cross beam; 23—rear cross beam; 24—rear screw hole; 31—front screw hole AA; 32—rear screw hole BA; 33—front support bar screw hole; 34—rear support bar screw hole; 51—front arc board; 511—front screw hole AB; 512—front screw hole B; 513—front screw hole C; 514—front screw hole D; 61—rear straight board; 611—rear screw hole A; 612—rear screw hole BB; 613—rear screw hole C; 614—rear screw hole D.

DETAILED DESCRIPTION OF THE EMBODIMENTS

The technical solution of the present utility model will be clearly and completely described below with reference to the accompanying drawings, and it is obvious that the described embodiments are some embodiments of the present utility model rather than all embodiments. Based on the embodiments in the present utility model, all the other embodiments obtained by a person skilled in the art without involving any inventive effort fall within the scope of protection of the present utility model.

In the description of the present utility model, it should be noted that the orientation or positional relationship indicated by the terms "center", "upper", "lower", "left", "right", "vertical", "horizontal", "inner", "outer", etc. is based on the orientation or positional relationship shown in the drawings, merely to facilitate the description of the present utility model and simplify the description, and does not indicate or imply that the device or element referred to must have a particular orientation, be constructed and operated in a particular orientation, and thus should not be construed as limiting the present utility model. Further, the terms "first", "second", and "third" are used for descriptive purposes only and are not to be construed as indicating or implying relative importance.

In the description of the present utility model, it should be noted that, unless expressly specified and limited otherwise, the terms "mounted", "connected to" and "connected" are to be interpreted broadly, for example, either fixedly or detachably or integrally; may be a mechanical connection or an electrical connection; it can be directly connected or indirectly connected through an intermediate medium, and can be the communication between two elements. For a person skilled in the art, the specific meaning of the above-mentioned terms in the present utility model can be understood in detail.

The present utility model will be further explained with reference to specific embodiments.

Figure 2:
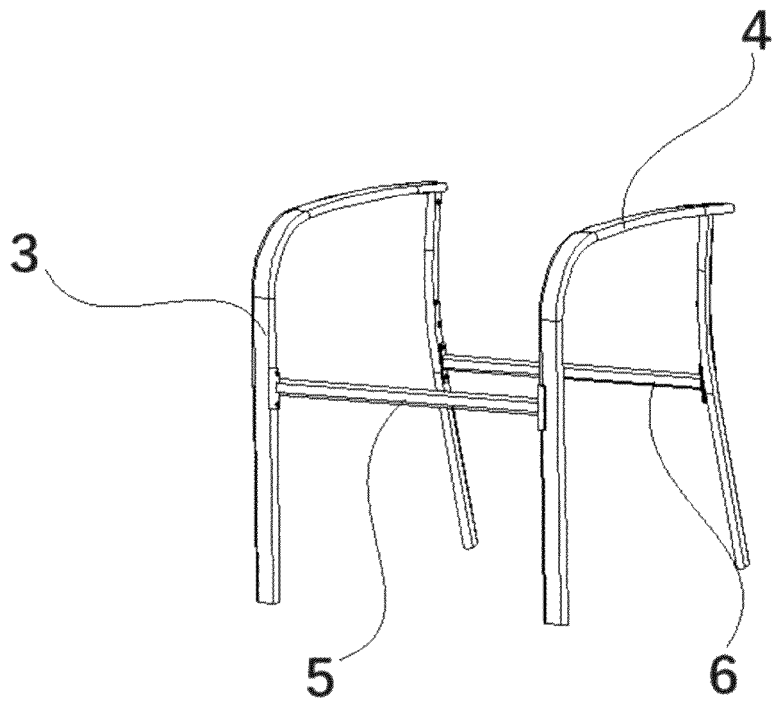
FIG. 2 is a schematic diagram showing the support bar of FIG. 1.
Figure 3:
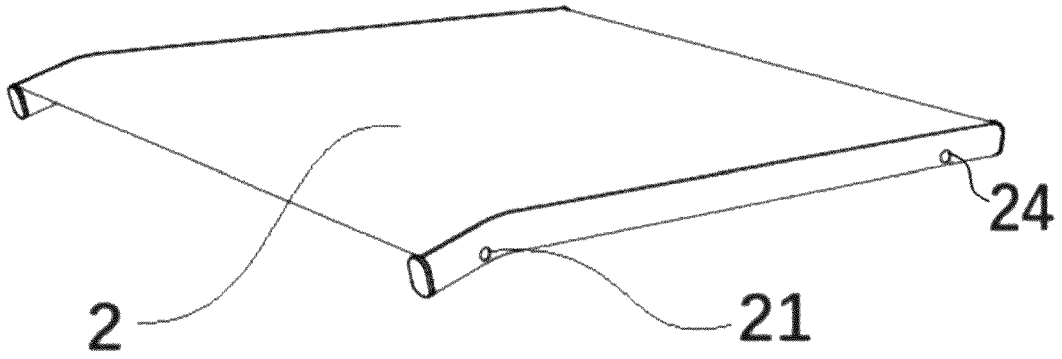
FIG. 3 is a schematic diagram showing the seat board of the chair of FIG. 1.
Figure 4:
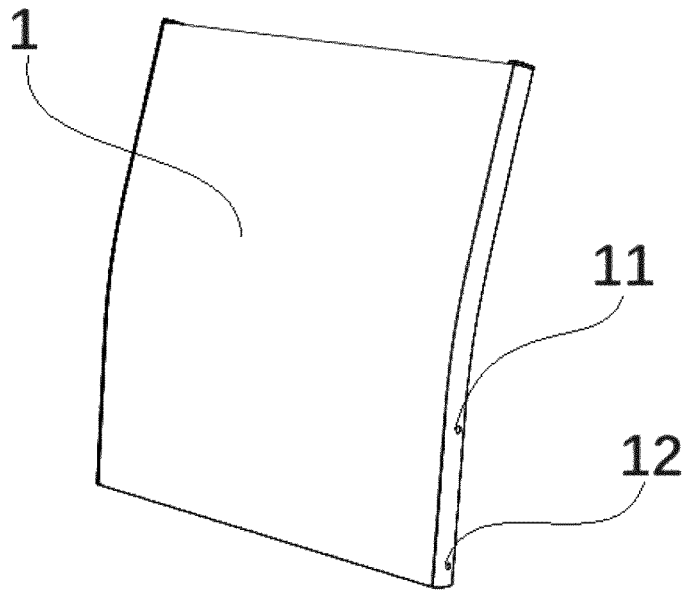
FIG. 4 is a schematic diagram showing the backrest of the chair of FIG. 1.
Figure 5:
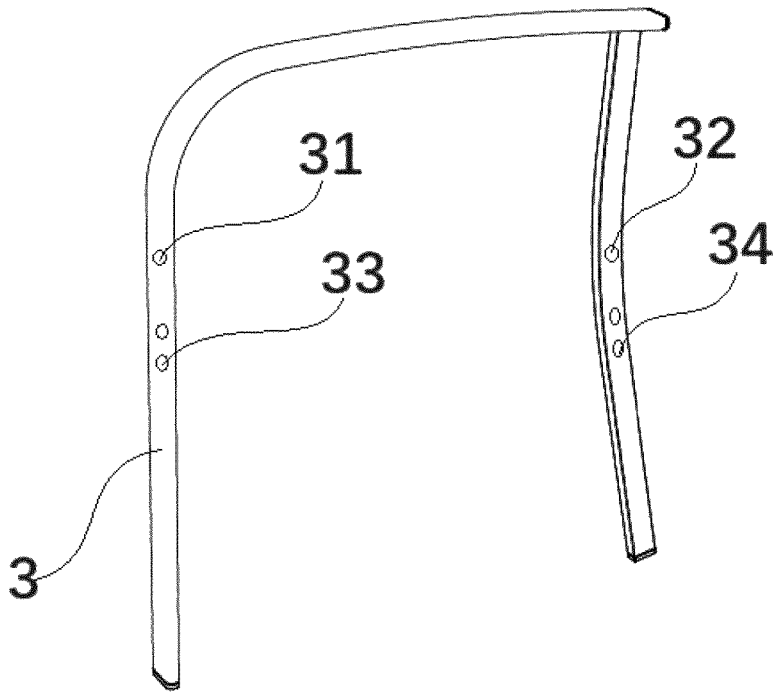
FIG. 5 is a schematic diagram showing the left armrest of FIG. 1.
Figure 6:
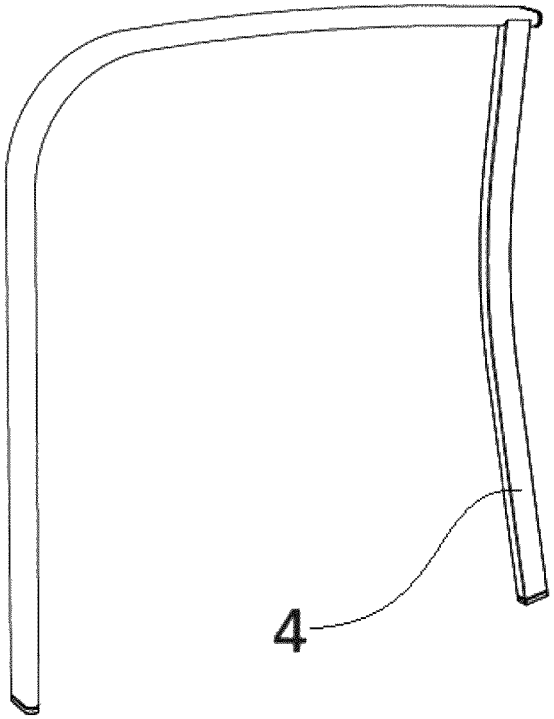
FIG. 6 is a schematic diagram showing the right armrest of FIG. 1.
Figure 7:
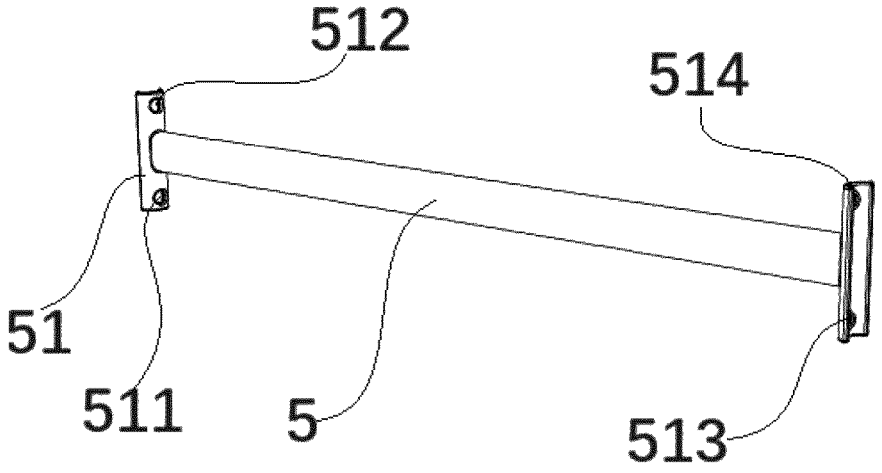
FIG. 7 is a schematic diagram showing the front support bar of FIG. 1.
Figure 8:
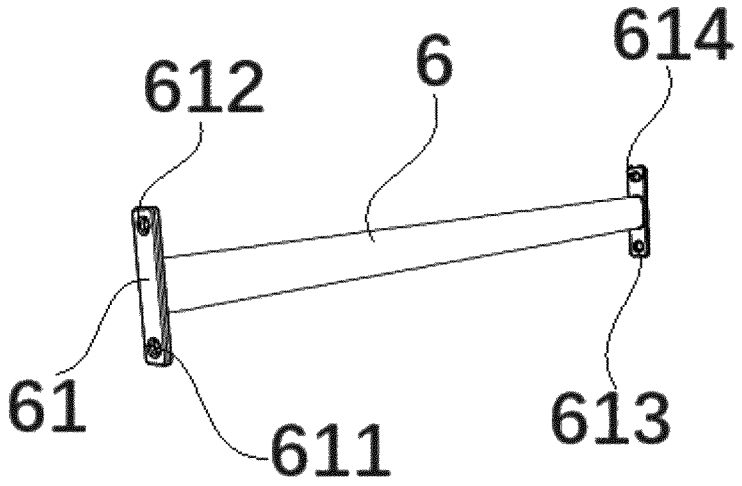
FIG. 8 is a schematic diagram showing the rear support bar of FIG. 1.
Figure 9:
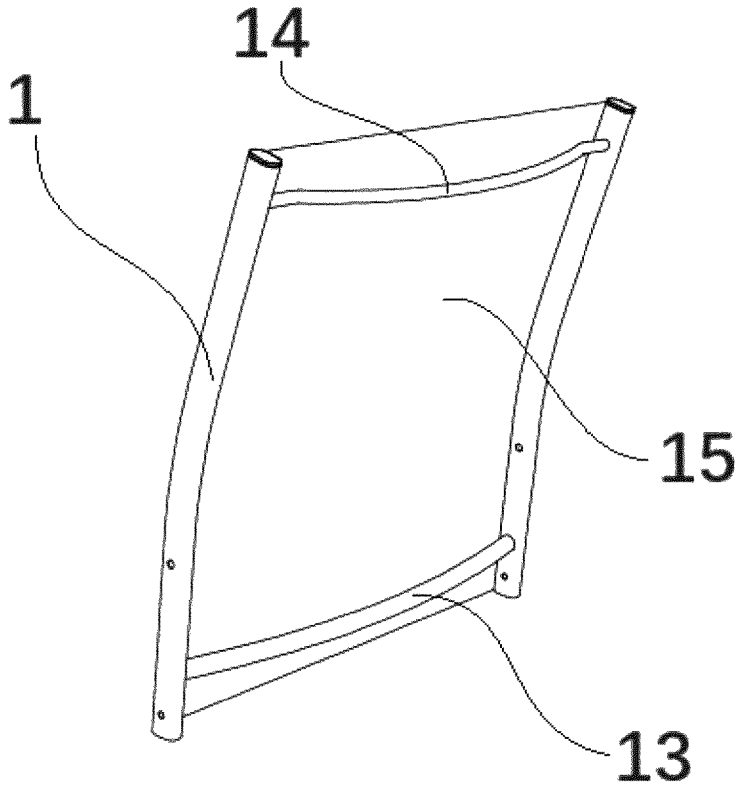
FIG. 9 is a schematic rear view showing the backrest of the chair of FIG. 1.
Figure 10:
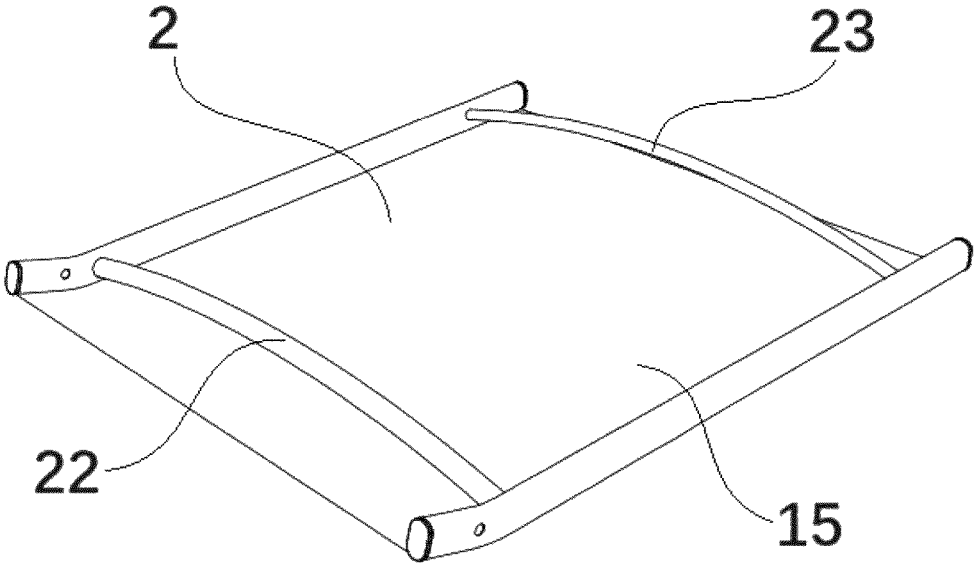
FIG. 10 is a schematic rear view showing the seat board of FIG. 1.

As shown in FIGS. 1-8, the present embodiment provides an easy-to-transport chair including a left armrest 3 and a right armrest 4 provided symmetrically and bolted by a front support bar 5 and a rear support bar 6; a seat board 2 being horizontally bolted on the inner sides of the symmetrical left armrest 3 and right armrest 4, and a backrest 1 being vertically bolted on the symmetrical left armrest 3 and right armrest 4; wherein the left armrest 3 and the right armrest 4 are sized and structured the same. Preferably, the left armrest 3 and the right armrest 4 are both inverted U-shaped, and the inverted U-shaped structure is strong, stable and easy to assemble. The backrest and the seat board of the seat are fixed by two U-shaped armrests, and the assembly method is simple.

In the present embodiment, the backrest 1, the seat board 2, the left armrest 3, the right armrest 4, the front support bar 5 and the rear support bar 6 are all separate parts and can be disassembled, so that the assembly and packaging are convenient, the packaging space is reduced, and the transportation cost is reduced.

In the present embodiment, a front screw hole AA31, a rear screw hole BA32, a front support bar screw hole 33, and a rear support bar screw hole 34 are respectively provided on the body of the left armrest 3. The front support bar 5 is respectively bolted to the front screw hole AA31 and the front support bar screw hole 33 on the front side of the left armrest 3 and the right armrest 4 to support the left and right armrests and enhance the robustness; the rear support bars 6 are bolted to the rear screw holes B32 and the rear support bar screw holes 34 of the rear sides of the left and right armrests 3 and 4, respectively, to further enhance the stability of the left and right armrests.

In the present embodiment, front screw holes 21 on both sides of the front end of the body of the seat board 2 are adapted to be bolted on the front sides of the left armrest 3 and the right armrest 4; the rear screw holes 24 on both sides of the rear end of the chair seat board 2 body thereof are adapted to be bolted on the rear sides of the left armrest 3 and the right armrest 4. The seat board is horizontally provided at both ends of the left and right armrests, and is bolted to enhance the stability of the seat board.

In the present embodiment, an upper screw hole 11 and a lower screw hole 12 in the backrest 1 are bolted to the rear sides of the left armrest 3 and the right armrest 4. Both side surfaces of the lower portion of the backrest body are fixed to the rear sides of the left and right armrests by bolts, and the lower portion of the backrest body thereof is close to the rear side surface of the seat board.

Preferably, the left armrest 3 and the right armrest 4 are higher than the horizontally provided seat board 2.

In the present embodiment, a front arc board 51 is fixedly provided at both ends of the body of the front support bar 5, and a front screw hole AB511, a front screw hole B512, a front screw hole C513 and a front screw hole D514 are respectively provided at both ends of the front arc board 51 away from the front support bar 5. The stability and robustness of the left and right armrests are enhanced by fixing the front sides of the two left and right armrests through front screw holes provided through arc-shaped boards 51 on the front support bar 5. In addition, the arc-shaped board 51 is adapted to abut against the outer walls of the left and right armrests, further enhancing the robustness of the front support bar 5.

In the present embodiment, a rear straight board 61 is fixedly provided at both ends of the body of the rear support bar 6, and a rear screw hole A611, a rear screw hole BB612, a rear screw hole C613 and a rear screw hole D614 are respectively provided at both ends of the rear straight board 61 away from the rear support bar 6. The stability and robustness of the left and right armrests are enhanced by fixing the rear sides of the two left and right armrests through rear screw holes provided through a straight board 61 on the rear support bar 6. In addition, the rear straight board 61 is adapted to abut against the outer walls of the left and right armrests, further enhancing the robustness of the rear support bar 6.

In the present embodiment, the an interwoven PVC-coated polyester fabric (Textilene®, a commercial fabric material) 15 is fixedly provided on the front surfaces of the body of the backrest 1 and the body of the seat board 2, respectively. A cross beam is fixedly provided on the opposite surfaces of the body of the backrest 1 and the body of the seat board 2, respectively, thereby enhancing the stability of the backrest and the seat board. The user can also arrange any of PU cloth, mesh cloth, cloth, artificial leather, dermis, suede on the backrest 1 and the seat board 2 according to the requirements.

Preferably, an upper portion of the body of the backrest 1 is laterally provided with an upper cross beam 14, and the lower portion thereof is laterally provided with a lower cross beam 13. The provision of double cross beams on the body of the backrest 1 enhances the stability and robustness of the backrest.

Preferably, the front portion of the body of the seat board 2 is laterally provided with a front cross beam 22, and the rear portion thereof is laterally provided with a rear cross beam 23. The provision of double cross beams on the body of the seat board 2 enhances the stability and robustness of the seat board.

The seat supports the stability and robustness of the left and right armrests via two support bars, and a fixed seat board is horizontally mounted on the inner sides of the left and right armrests, and a backrest is vertically mounted and fixed close to the seat board; the seat is simple in construction, easy to disassemble and assemble, individual parts are independent and easy to package, reducing the space occupied by the seat package and transportation costs.

Finally, it should be noted that: the above-mentioned embodiments are merely illustrative of the technical solution of the present invention, rather than limiting same; although the present utility model has been described in detail with reference to the foregoing embodiments, those skilled in the art will understand that: the technical solutions disclosed in the above-mentioned embodiments can still be amended, or some or all of the technical features thereof can be replaced by equivalents; however, these modifications or substitutions do not make the essence of the corresponding technical solutions depart from the scope of the technical solutions of the various embodiments of the present invention.

What is claimed is:

1. An easy-to-transport chair, comprising a left armrest (3) and a right armrest (4) provided symmetrically and bolted by a front support bar (5) and a rear support bar (6); a seat board (2) being horizontally bolted on the inner sides of the symmetrical left armrest (3) and right armrest (4), and a backrest (1) being vertically bolted on the symmetrical left armrest (3) and right armrest (4); wherein the left armrest (3) and the right armrest (4) are sized and structured the same and an interwoven PVC-coated polyester fabric (15) is fixedly provided on the front surface of the body of the backrest (1) and the body of the seat board (2), respectively;

the left armrest (3) and the right armrest (4) are both inverted U-shaped, the backrest and the seat board of the seat are fixed by two inverted U-shaped armrests;

wherein a front arc board (51) is fixedly provided at both ends of the body of the front support bar (5), and a front screw hole A (511), a front screw hole B (512), a front screw hole C (513) and a front screw hole D (514) are respectively provided at both ends of the front arc board (51) away from the front support bar (5);

wherein a rear straight board (61) is fixedly provided at both ends of the body of the rear support bar (6), and a rear screw hole A (611), a rear screw hole B (612), a rear screw hole C (613), and a rear screw hole D (614) are respectively provided at both ends of the rear straight board (61) away from the rear support bar (6);

wherein each of the left armrest (3) and the right armrest (4) comprises a front leg portion and a rear leg portion spaced apart from each other, wherein the front leg portion has an arcuate outer profile corresponding to a shape of the front arc board (51) and is connected to the front arc board (51), and the rear leg portion has a rectilinear outer profile corresponding to a shape of the rear straight board (61) and is connected to the rear straight board (61);

wherein the front leg portion and the rear leg portion are connected to each other by a connecting plate located at respective end portion regions of the front leg portion and the rear leg portion to form the inverted U-shaped, and no additional connecting member extends between the front leg portion and the rear leg portion.

2. The easy-to-transport chair according to claim 1, wherein the backrest (1), the seat board (2), the left armrest (3), the right armrest (4), the front support bar (5) and the rear support bar (6) are separate parts and detachable.

3. The easy-to-transport chair according to claim 2, wherein the left armrest (3) and the right armrest (4) are higher than the horizontally provided seat board (2).

4. The easy-to-transport chair according to claim 1, wherein the front support bar (5) is bolted to the front sides of the left armrest (3) and the right armrest (4).

5. The easy-to-transport chair according to claim 1, wherein the rear support bar (6) is bolted to the rear sides of the left armrest (3) and the right armrest (4).

6. The easy-to-transport chair according to claim 1, wherein front screw holes (21) on both sides of the front end of the body of the seat board (2) are adapted to be bolted on the front sides of the left armrest (3) and the right armrest (4); the rear screw holes (24) on both sides of the rear end of the body of the chair seat board (2) thereof are adapted to be bolted on the rear sides of the left armrest (3) and the right armrest (4).

7. The easy-to-transport chair according to claim 1, wherein an upper screw hole (11) and a lower screw hole (12) in the backrest (1) are bolted to the rear sides of the left armrest (3) and the right armrest (4).

* * * * *